US006256912B1

(12) United States Patent
Gibson et al.

(10) Patent No.: US 6,256,912 B1
(45) Date of Patent: Jul. 10, 2001

(54) MULTI-SIDED DISPLAY HOLDER

(75) Inventors: Scott S. Gibson, Mercer Island; Spec Fulmar, Kent, both of WA (US)

(73) Assignee: Burke Gibson, Inc., Auburn, WA (US)

( * ) Notice: Subject to any disclaimer, the term of this patent is extended or adjusted under 35 U.S.C. 154(b) by 0 days.

(21) Appl. No.: 09/410,647

(22) Filed: Oct. 1, 1999

(51) Int. Cl.[7] ..... G09F 11/02
(52) U.S. Cl. ..... 40/503; 40/493; 40/506
(58) Field of Search ..... 40/493, 503, 504, 40/505, 506

(56) References Cited

U.S. PATENT DOCUMENTS

| | | | | |
|---|---|---|---|---|
| 1,475,041 | | 11/1923 | Alstott . | |
| 1,521,995 | | 1/1925 | Burbank . | |
| 3,199,239 | | 8/1965 | Reed . | |
| 3,367,049 | | 2/1968 | Noreen . | |
| 3,387,394 | | 6/1968 | Werner . | |
| 4,060,920 | * | 12/1977 | Edwards | 40/503 |
| 4,528,763 | | 7/1985 | Ahlgren . | |
| 5,003,716 | | 4/1991 | Dyar . | |
| 5,233,772 | | 8/1993 | Bergeron . | |
| 5,347,734 | | 9/1994 | Howell et al. . | |
| 5,416,996 | * | 5/1995 | Clemens et al. | 40/505 |
| 5,485,693 | | 1/1996 | Frenken . | |
| 5,528,258 | | 6/1996 | Moon . | |
| 5,560,131 | | 10/1996 | Gibson | 40/607 |

FOREIGN PATENT DOCUMENTS

| | | | |
|---|---|---|---|
| 2 250 122A | 5/1992 | (GB) | G09F/11/02 |
| WO 92/11621 | 7/1992 | (WO) | G09F/11/02 |

* cited by examiner

*Primary Examiner*—Joanne Silbermann
(74) *Attorney, Agent, or Firm*—Delbert J. Barnard

(57) ABSTRACT

Identical side members (32) may be connected together by mortise (46) and tenon (52) structure to provide an elongated display holder (10, 22), preferably having a substantially triangular cross sectional shape. Corner structures (54, 56, 58) may be provided which include slots (70, 72) that confront each other and receive edge portions of display members (74). The side members (32) may include outwardly openings T-slots (76) which receive divider strips (82). The divider strips include oppositely directed slots (92, 94) which confront the corner slots (70, 72). This provides the display area on one side of the display holder with two parallel display regions for receiving substantially half width display members (96, 98). The display holder may be mounted horizontally (FIG. 1) or vertically (FIGS. 2 and 11). The side members (32') may be laterally curved, even to the extent of providing the display holder with a substantially cylindrical shape (FIG. 15).

28 Claims, 7 Drawing Sheets

FIG. 5
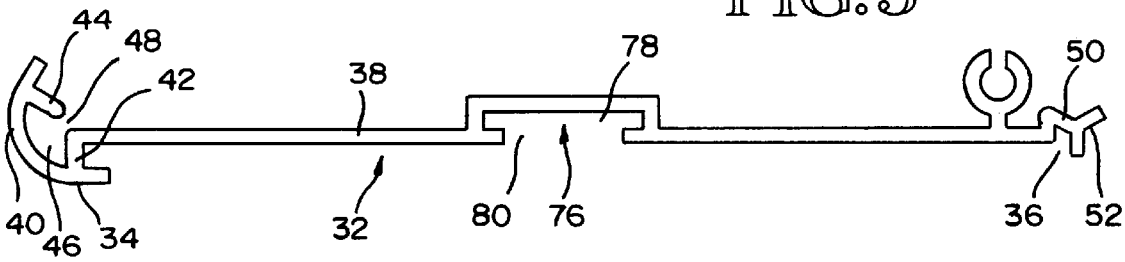
FIG. 6
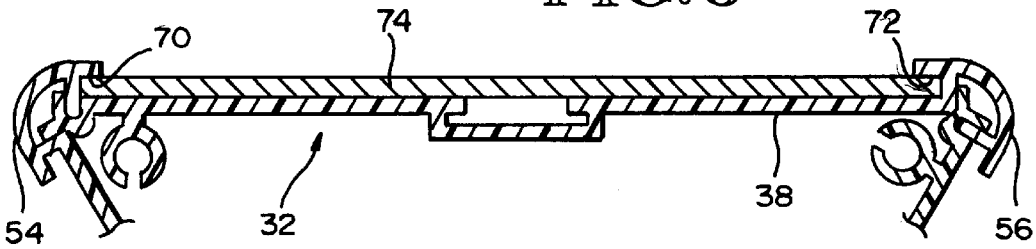
FIG. 7
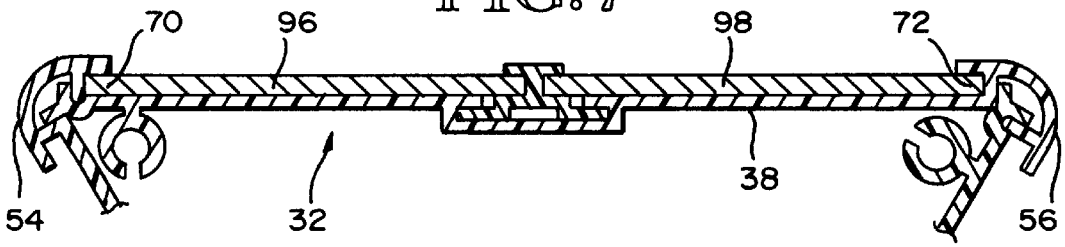
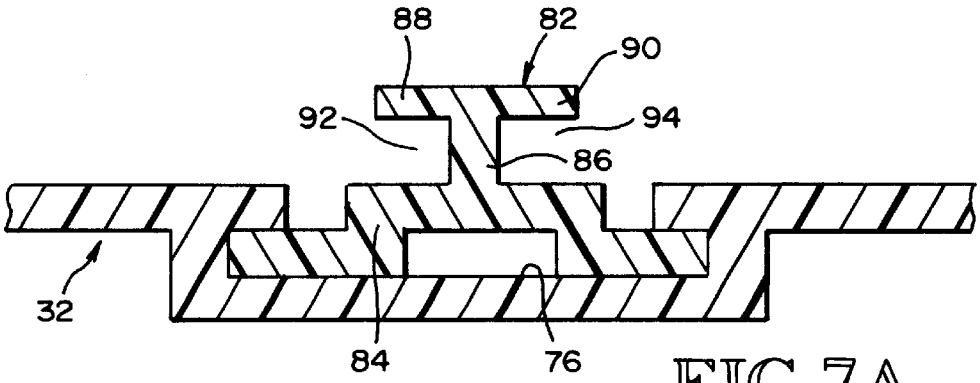
FIG. 7A

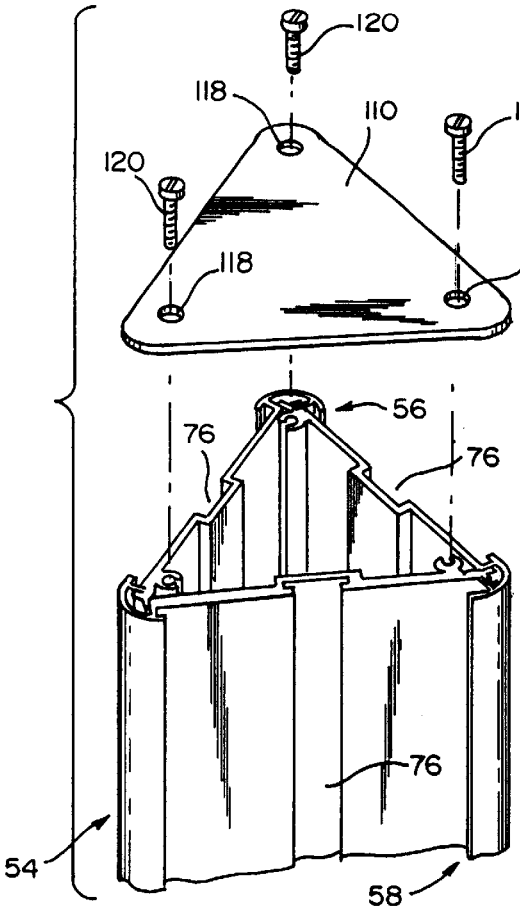
FIG. 8
FIG. 9
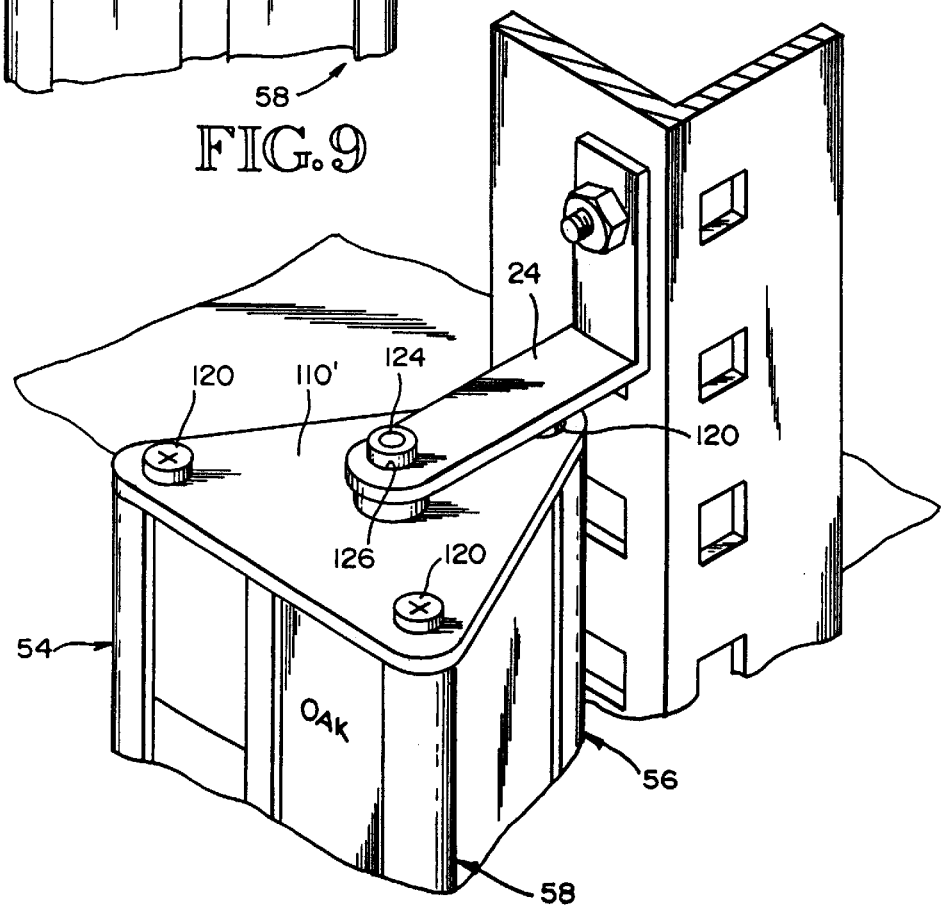

MULTI-SIDED DISPLAY HOLDER

TECHNICAL FIELD

This invention relates to display holders. More particularly, it relates to the construction and mounting of multi-sided display holders.

BACKGROUND OF THE INVENTION

A popular two sided display holder is disclosed by U.S. Pat. No. 5,419,134, granted May 30, 1995, to Scott S. Gibson and entitled Display Holder. For background purposes, U.S. Pat. No. 5,419,134 identifies a number of United States patents relating to various types of sign boards or display holders that are adapted to be mounted in a vertical orientation.

Three and four sided sign boards or display holders are disclosed by the following additional United States patents: U.S. Pat. No. 1,575,041, granted Nov. 20, 1923, to James W. Alstott; No. 1,521,995, granted Jan. 6, 1925, to Edward A. Burbank; No. 3,199,239, granted Aug. 10, 1965, to Theodore M. Reed; No. 3,387,394, granted Jun. 11, 1968, to Willy T. Werner; No. 3,367,049, granted Feb. 6, 1968, to Clarence L. Noreen; No. 4,528,763, granted Jul. 16, 1985, to Stig B. Ahlgren; No. 5,003,716, granted Apr. 2, 1991, to Royce M. Dyar; No. 5,233,772, granted Aug. 10, 1993, to Paul E. Bergeron and David L. Wood; No. 5,347,734, granted Sep. 20, 1994 to Lloyd A. Howell and Peter N. Kurlas; No. 5,485,693, granted Jan. 23, 1996, to Egbert Frenken and Michael Schoning; No. 5,528,258, granted Jun. 18, 1996, to Shin K. Moon; and No. 5,560,121, granted Oct. 1, 1986, to Scott S. Gibson. Three sided display holders are also disclosed by United Kingdom publication 2,250,122A, published May 27, 1992, and filed by Edward Maurice Pearce Butler; and by Patent Cooperation Treaty publication No. WO 92/116, published Jul. 9, 1992, on an application filed by Paul E. Bergeron and David L. Wood.

There is a need for a multi sided display holder, and in particular a three sided display holder, that is capable of being mounted in either a vertical or horizontal orientation, and which can be easily manufactured in sections that can be easily assembled to form the display holder.

An object of the present invention is to provide an easy to manufacture, easy to assembly and easy to mount display holder.

Another object of the invention is to provide a multi sided display holder that is adapted to provide plural display regions on one, two, or all of its sides.

A further object of the invention is to provide a multi sided display holder that is adapted to have either a vertical or horizontal orientation.

BRIEF SUMMARY OF THE INVENTION

The present invention includes providing a display holder comprising three side members. Each side member has a first margin portion, a second margin portion and an intermediate panel portion. Each first margin portion includes a longitudinal mortise. Each second margin portion includes a longitudinal tenon sized to be received within a said longitudinal mortise. The tenon of each side member is received within a longitudinal mortise of an adjacent side member. The engagement of the tenons and mortises connect the side members together to form an elongated, three sided hollow body having three corners.

In preferred construction, each first margin portion includes an outside corner wall and a pair of mortise sidewalls extending inwardly from the corner wall. The corner and mortise sidewalls together form the longitudinal mortise and form a narrow entrance slot for the mortise. In preferred construction, each second margin portion includes a narrow stem extending from the panel portion outwardly to the tenon.

A first of the mortise sidewalls may be connected to and may extend perpendicularly outwardly from the panel portion of the first side member at the corner, to a connection with the corner wall. The corner wall is laterally curved. The second mortise sidewall extends substantially radially inwardly from the curved corner wall and includes a free edge that is spaced from where the first mortise sidewall is connected to the panel portion of the first side member. A narrow slot entrance to the mortise is formed by and between the free edge of the second mortise sidewall and a corner formed where the first mortise sidewall meets and is connected to the panel portion of the first side member.

A preferred construction, at each corner the tenon has side surfaces that are contiguous inside surfaces of the mortise. A stem extends from a connection with the panel portion of the second side member, to and through the narrow slot to a connection to the tenon.

According to an aspect of the invention, on at least two sides of the display holder, confronting slots are provided that receive edge portions of a display member.

According to yet another aspect of the invention, one of the confronting slots is formed at the first corner of the display holder and the other confronting slot is formed at a second corner of the display holder.

According to yet another aspect of the invention, at least one of the sidewalls includes a longitudinal T-slot, and the display holder includes a divider strip having an elongated T-bar that is received in the T-slot. The T-bar includes a perpendicular stem wall and at least one flange connected to the perpendicular stem wall. The flange, the perpendicular wall and a base portion of the T-bar form a slot that confronts a corner slot and is sized to receive an edge portion of a display member.

According to yet another aspect of the invention, one side member includes an elongated T-slot that receives a T-bar that is a part of structure used for mounting the display holder on some object.

In preferred form, the panel portions of the side members are laterally straight. However, the invention includes making the side members with intermediate panel portions that are laterally curved. According to an aspect of the invention, a display holder can be formed from side members with laterally curved panel portions to form an elongated hollow body that is substantially cylindrical in shape.

The invention includes mounting the hollow body to extend horizontally. It further includes mounting the hollow body to extend vertically. Whether horizontal or vertical, the hollow body may be mounted for rotation about a longitudinal axis.

According to an aspect of the invention, the hollow body is provided with end members and mounting brackets are connected to the end members, for mounting the display holder. The mounting brackets may include pivot connections for mounting the display holder for rotation about a longitudinal axis.

Other objects, advantages and features of the invention will become apparent from the description of the best mode set forth below, from the drawings, from the claims and from the principles that are embodied in the specific structures that are illustrated and described.

BRIEF DESCRIPTION OF THE SEVERAL VIEWS OF THE DRAWING

Like reference numerals are used to designate like parts throughout the several figures of the drawing, and:

FIG. 5 is an end view of one of three side members which together form the main body of the display holder;

FIG. 6 is a fragmentary cross sectional view of the display holder, including a sectional view of a full width display member;

FIG. 7 is a view like FIG. 6, but showing the use of a pair of half width display members;

FIG. 7A is a fragmentary end view of a T-slot region of a sidewall, showing a T-bar within the T-slot, defining slots sized for receiving edge portions of a display member;

FIG. 8 is a fragmentary view of an end portion of a vertically oriented display holder, showing an end member spaced upwardly from the assembly of side members that form the display holder body, and further showing screws in alignment with openings in the end member and with end openings in screw receiving members that are apart of the side members;

FIG. 9 is an enlarged scale fragmentary view at the upper end of the embodiment of FIG. 2, showing detail of the mounting structure at such end;

DETAILED DESCRIPTION OF THE INVENTION

Figure 1:
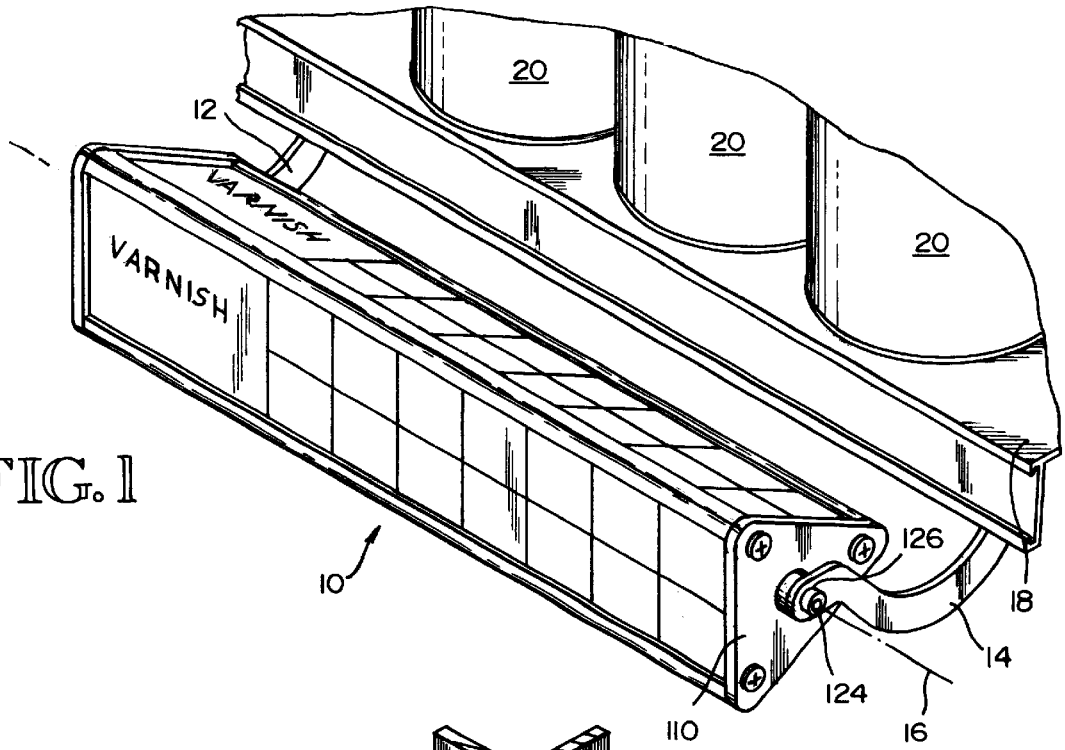
FIG. 1 is a pictorial view of a first embodiment of the invention, such view being taken from above, and looking towards the top, one side and one end of the display holder, such view showing the display holder mounted horizontally, in a position forwardly of a shelf, by brackets that extend outwardly from the shelf to connections with the end of the display holder.

FIG. 1 shows a display holder 10, constructed in accordance with the present invention. In FIG. 1, display holder 10 is shown to be mounted by a pair of mounting brackets 12, 14 for pivotal movement about a horizontal axis 16. By way of typical and therefore non-limitive example, the brackets 12, 14 are connected to a shelf 18 in such a way that the display holder and its display members are positioned forwardly of the shelf 12. Cans of paint 20, for example, may be stored and displayed on the shelf 18.

Figure 2:
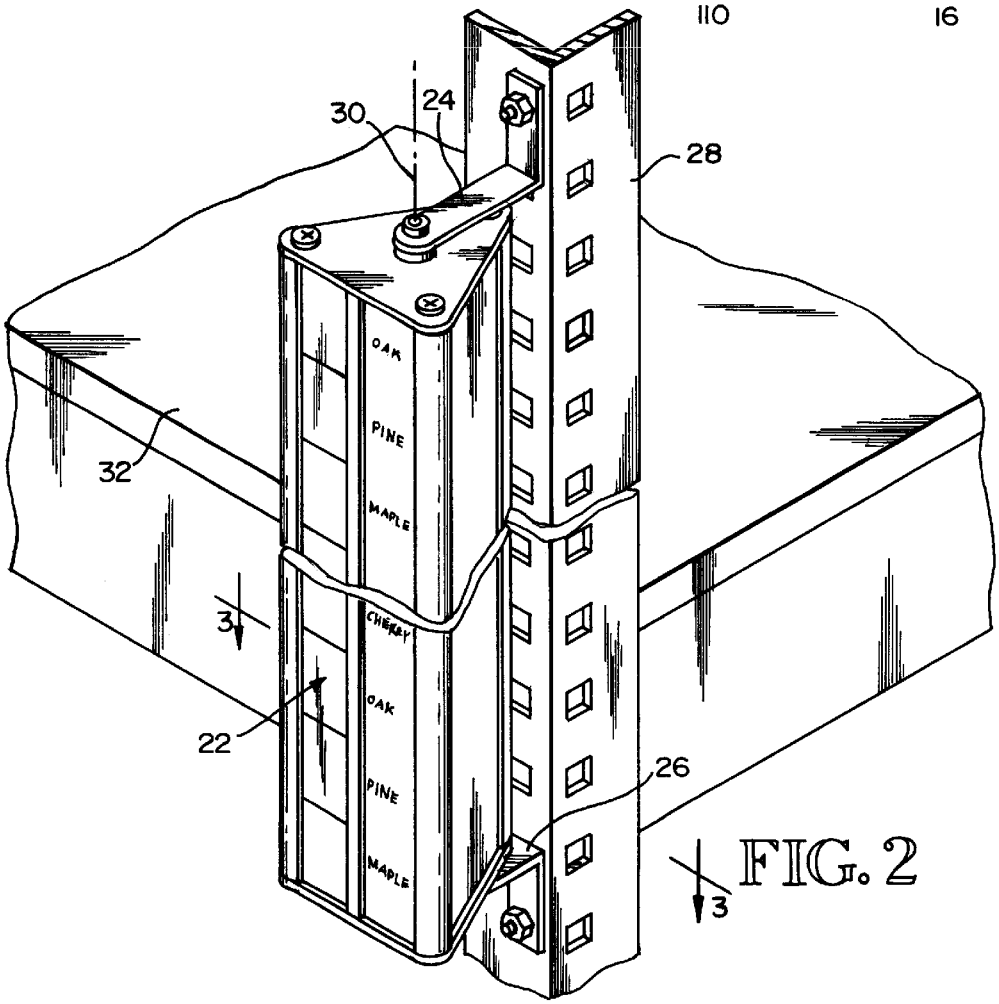
FIG. 2 is a fragmentary pictorial view of a second embodiment of the invention, in which the display holder is vertically oriented, such view showing the display holder and a support post broken away being their ends, to indicate indeterminate length, and showing mounting brackets projecting outwardly from the post to points of connection with the display holder at the ends of the display holder.

FIG. 2 shows a similar display 22 that is vertically oriented. It is shown to be mounted by upper and lower brackets 24, 26, to an object such as a post 28, for example, for rotation about a vertical axis 30. In this embodiment, the display holder 22, and its display members are positioned adjacent shelving 32 which may hold products that are described by the displayed information.

In both embodiments, the customer can approach the display 10 or 22 and rotate it by hand to view the various information that is displayed on each of its three sides.

Figure 3:
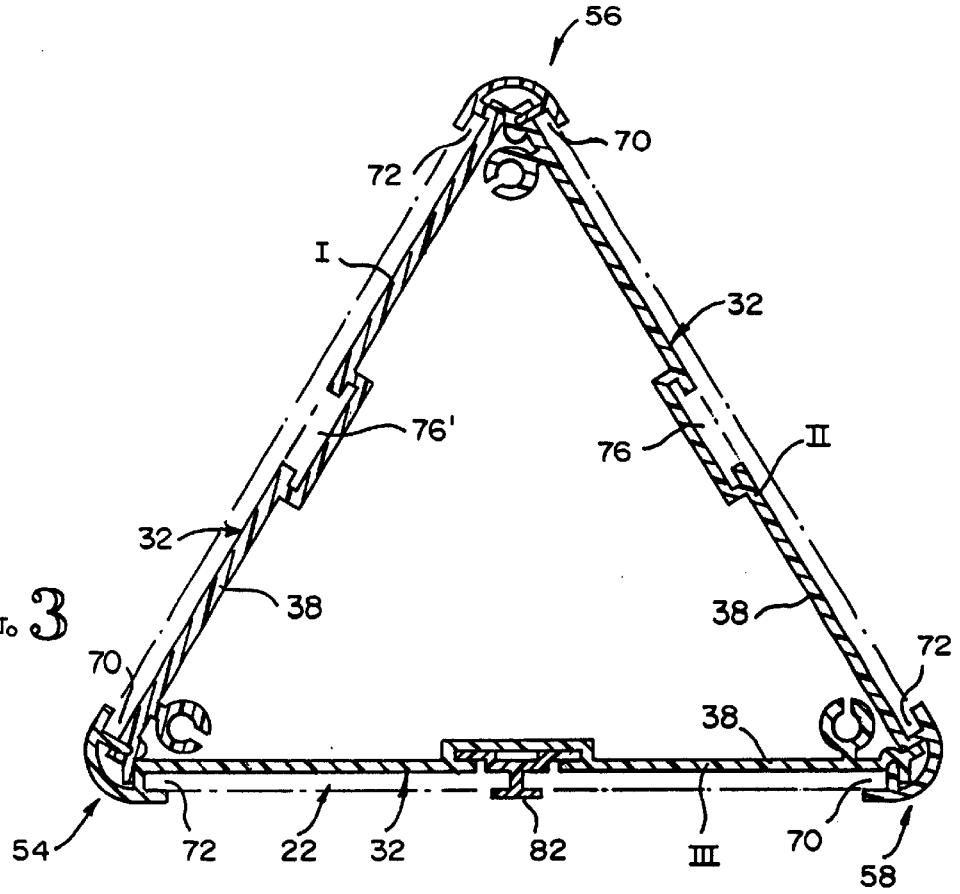
FIG. 3 is a cross sectional view taken through the display holder of FIG. 2, such view showing full width display members on two sides of the display holder and a pair of half width display members on the third-side, such display members being shown in broken line for clarity of illustration of the display holder.

FIGS. 3–8 shows the basic components of the preferred embodiment of the invention. In preferred form, the display holder 10, 22 has an elongated hollow body that is formed by three identical side members 32. FIG. 3 shows the three side members 32 connected together to form the hollow body. FIG. 3 is a sectional view through line 3—3 of FIG. 2 but it just as well could be a sectional view through display holder 10. FIG. 5 is an end view of a side member 32. The side member 32 maintains the cross section that is illustrated throughout its full length. Side member 32 is preferably extruded from a suitable structural plastic.

Figure 4:
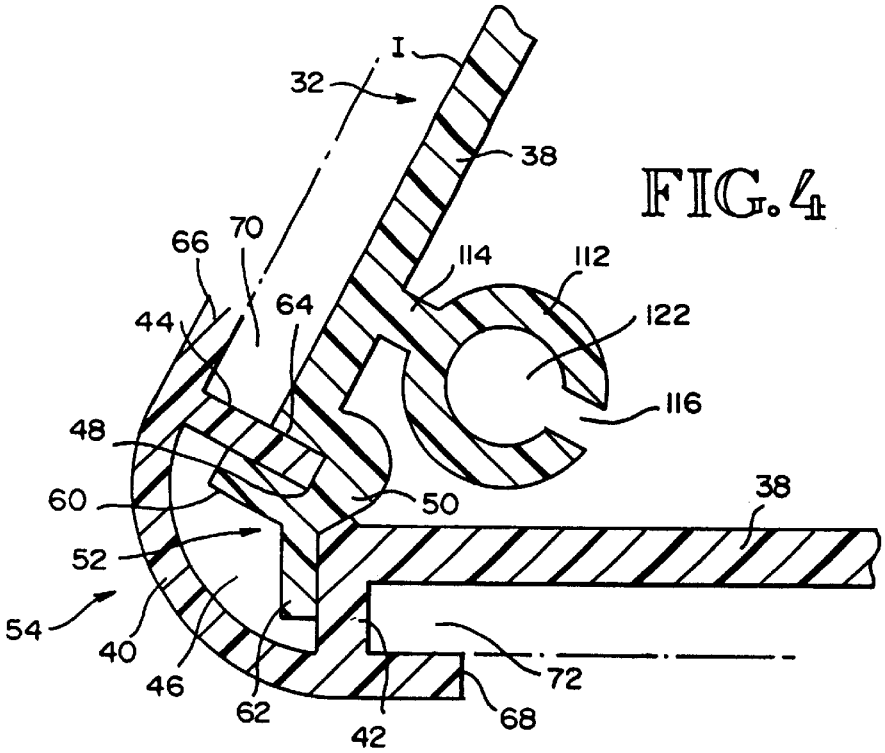
FIG. 4 is an enlarged scale view of a corner portion of FIG. 3, such view showing the structural makeup of the corner structure.

Each side member 32 includes a first margin portion 34, a second margin portion 36 and an intermediate panel portion 38. The first margin portion 34 includes an outside corner wall 40 and a pair of mortise sidewalls 42, 44. Both of the mortise sidewalls 42, 44 extend inwardly from the corner wall 40. In preferred form, the corner wall 40 is laterally curved and the mortise sidewalls 42, 44 extend substantially radially inwardly from the corner wall 40. As illustrated, the corner wall 40 and the mortise sidewalls 42, 44 together form a longitudinal mortise 46 having a narrow entrance slot 48. Each second margin portion 36 includes a narrow stem 50 and a tenon 52 that is positioned outwardly of the stem 50 and is wider than the stem 50. As best shown by FIG. 4, each tenon 52 is sized to be received within a mortise 40 of one of the other side members 32. Each narrow stem 50 is sized to be received within an entrance slot 48 when its tenon 52 is within a mortise 46. The mortise and tenon may be referred to as a dovetail mortise and tenon. When three of the side members 32 are connected together, the tenon 52 of each side member 32 is received within a longitudinal mortise 56 of an adjacent side member 32. Each narrow stem 50 is received within the entrance slot 48 for the associated mortise 46.

Referring to FIG. 3, for purposes of discussion, a first sidewall 32 is also designated sidewall I. A second sidewall 32 is also designated sidewall II. The third sidewall 32 is also designated sidewall III. Starting with the corner 54, at the lower left portion of FIG. 3, the tenon 52 of sidewall I is shown to be positioned within the mortise 46 of sidewall III. At the top corner 56, the tenon 52 of the second sidewall II is shown positioned within the mortise 46 of the first sidewall I. At the lower right portion of the view, showing corner 58, the tenon 52 of sidewall III is shown to be positioned within the mortise 46 of the sidewall II.

FIG. 4 presents an enlarged scale view of corner 54. It shows how the mortise 46 in tenon 52 fit together. Tenon 52 has two panel portions 60, 62. Tenon panel 60 is contiguous mortise sidewall 44. Tenon panel 62 is contiguous mortise sidewall 42. A slot 64 is formed between tenon panel 60 and a corner formed where panel 38 joins the base of stem 50. Mortise wall 44 snugly fits within the slot 64. This snug fit of mortise wall 54 within the slot 64, and the fit of tenon 52 within the mortise 46, with the tenon panels 60, 62 contacting the mortise sidewalls 42, 46, reinforces the corners 54, 56, 58 and makes the hollow body rigid in form.

In the preferred embodiment, the corner wall 40 includes longitudinal flanges 66, 68. Flange 66, mortise sidewall 44 and the portion of panel 38 that borders slots 62, form a display member receiving slot 70. Flange 68, mortise sidewall 42 and the portion of sidewall 38 that is connected to mortise sidewall 42 form a second display member receiving slot 72. Slot 70, 72 exist at each of the corners 54, 56, 58. This is best shown by FIG. 3. The slots 70, 72 extend throughout the entire length of the hollow body formed by the side members 32. As also clearly shown by FIG. 3, slot 70 at corner 54 confronts slot 72 at corner 56. Slot 70 at corner 56 confronts slot 72 at corner 58. Slot 70 at corner 58 confronts slot 72 at corner 54. FIG. 6 shows a full width display member 74 that extends the full length of the display holder 10, 22. It has side edge portions that are received within the confronting slots 70, 72.

According to an aspect of the invention, the intermediate panel 38 of each sidewall 32 is formed to include a T-slot 76. The slot 76 is called a T-slot because it has an inner portion 78 that is wider than its entrance portion 80, giving the slot 76 a substantially T-shaped cross section. This T-slot 76 has several functions. As shown by FIG. 7, for example, a T-bar 82 may be provided which fits snugly into the T-slot 76. The T-bar 82 may include a base 84, a perpendicular stem wall 86 and a pair of flanges 88, 90 extending in opposite directions from the perpendicular stem wall 82, parallel to the base wall 84. This construction provides a pair of intermediate slots 92, 94 sized for receiving side edge portions of half width display members 96, 98. Intermediate slot 92 confronts corner slot 70. Intermediate slot 94 confronts corner slot 72. Display member 96 is received within slots 70, 92. Display member 98 is received within slots 72, 94.

FIG. 7A presents an enlarged view of the region of the T-bar 82.

Figure 12:
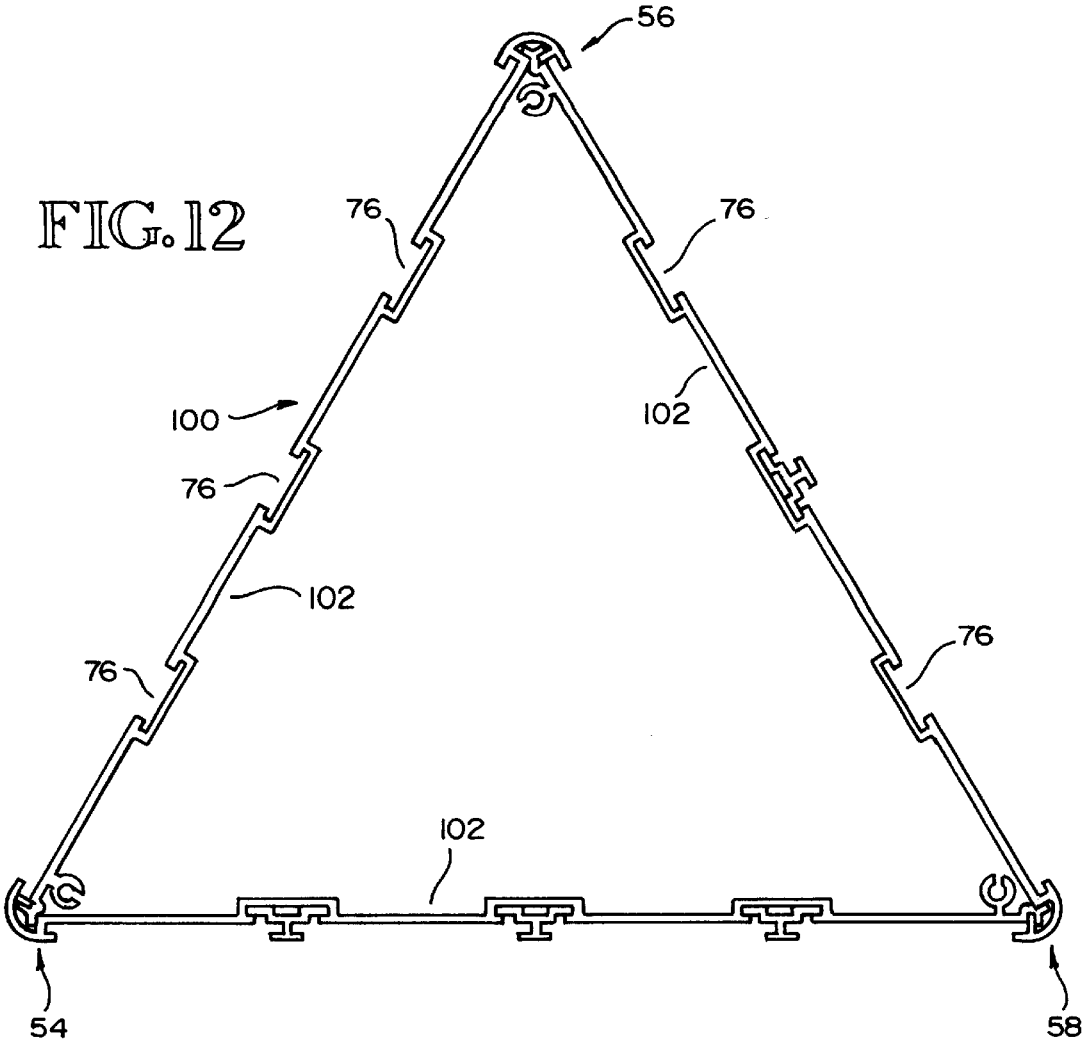
FIG. 12 is an end view of assembled side members of a further embodiment of the invention, showing a display holder that is wider than the display holder shown by FIGS. 1–11.
Figure 13:
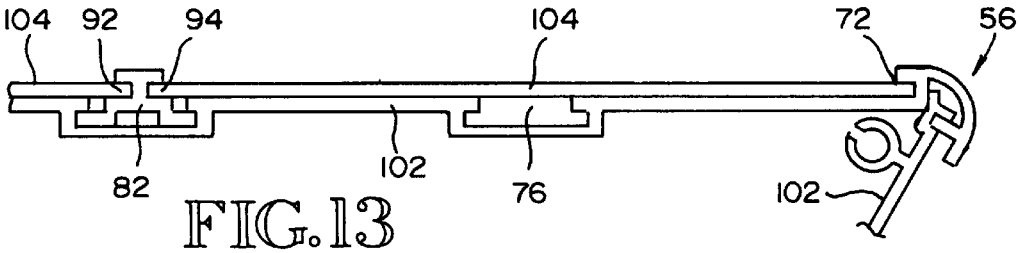
FIG. 13 is a fragmentary view of one side and corner portion of the display shown by FIG. 12, such view showing the use of half width display members.
Figure 14:
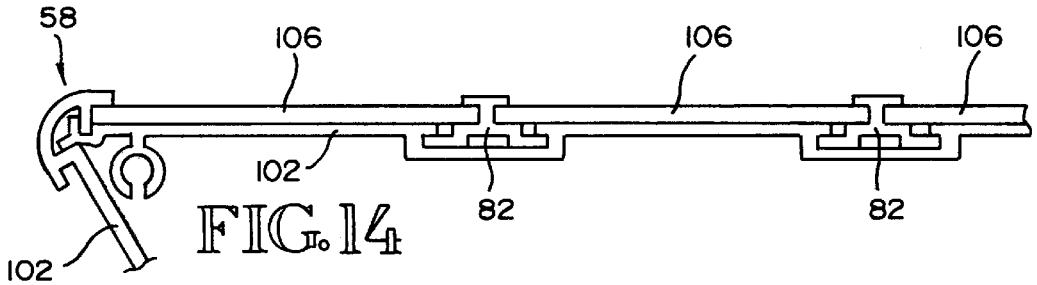
FIG. 14 is a view like FIG. 13, but of a different corner side portion of the display holder, such view showing one side of the display holder adapted to receive four display members.

FIG. 12 shows a larger display holder 100 having the same corner constructions 54, 56, 58 that have been described. Display holder 100 includes sidewalls 102 that are substantially wider than sidewalls 32. By way of example, each sidewall 102 may include three T-slots 76. FIG. 13 shows the placement of a divider T-bar 82 within the center T-slot 76 dividing the display width of one of the sidewalls 102 into two substantially equal width regions for receiving substantially half width display members 104. FIG. 14 shows a divider T-bar 82 in each T-slot 76 in the sidewall 102 that extends between corners 54 and 56. This divides the display region on this side of the display holder into four substantially equal regions, each of which receives a display member 106. Display members 106 extend longitudinally of the display holder and at their side edges are retained by confronting slots.

In addition to having a hollow body, the display holder 10, 22 of the present invention has end walls 110. Also, as clearly shown by FIGS. 3 and 4, the sidewalls 32 are formed to include a screw fastener receiving member 112, shown in FIGS. 3 and 4 to be connected to the panel portion 38 of the sidewall 32 adjacent the margin portion 32 that includes the tenon 52. A perpendicular stem wall extends inwardly from panel portion 38 to the screw receiving member 112. Screw receiving member 112 has a generally cylindrical cross sectional shape, interrupted by a longitudinal slot 16 that is on the side of the member 112 opposite the wall 114. The wall 32 is an extrusion and the member 112 and the wall 114 are parts of the extrusion.

As shown by FIG. 8, each end wall 110 includes screw fastener openings 118. Threaded end portions of screw fasteners 120 are inserted through the openings 118, each into an opening 122 in the screw fastener receiving member 112. In the region of the threads, the screw fastener 120 is larger in diameter than the inside diameter of the opening 122. When the screw fastener 120 is rotated, such as by use of a screwdriver, the threads cut into the inner wall of the opening 122 and securely anchor the screw fastener 120 to the member 112. The screw fasteners 120 are rotated until their heads are down against the end wall 110.

Figure 11:
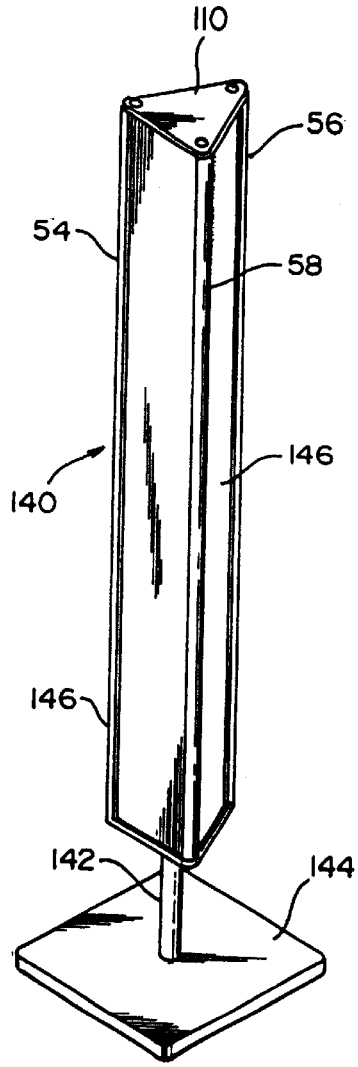
FIG. 11 is a pictorial view of a further embodiment of the invention, such view showing the display holder mounted on a post and the lower end of the post connected to a base.

FIG. 8 shows a solid end wall 110 such as would be used with the display holder shown by FIG. 11. A modified end wall 110' may be used. This wall 110' includes a center opening that receives a mechanism that serves to mount the display holder for rotation, either about a horizontal axis 16 (FIG. 1) or a vertical axis 30, (FIG. 2). A trunnion or axle 124 may be connected to the end wall 110', at the center opening. The axle 124 may extend through an opening 126 formed in the mounting bracket 14, 24. Or, the axle may be connected to the mounting bracket 14, 24 and constructed to include a portion that extends through the opening in the end wall 110'. Of course, various other ways may be used for mounting the display holder 10, 22 for rotation about an axis 16, 30.

Figure 10:
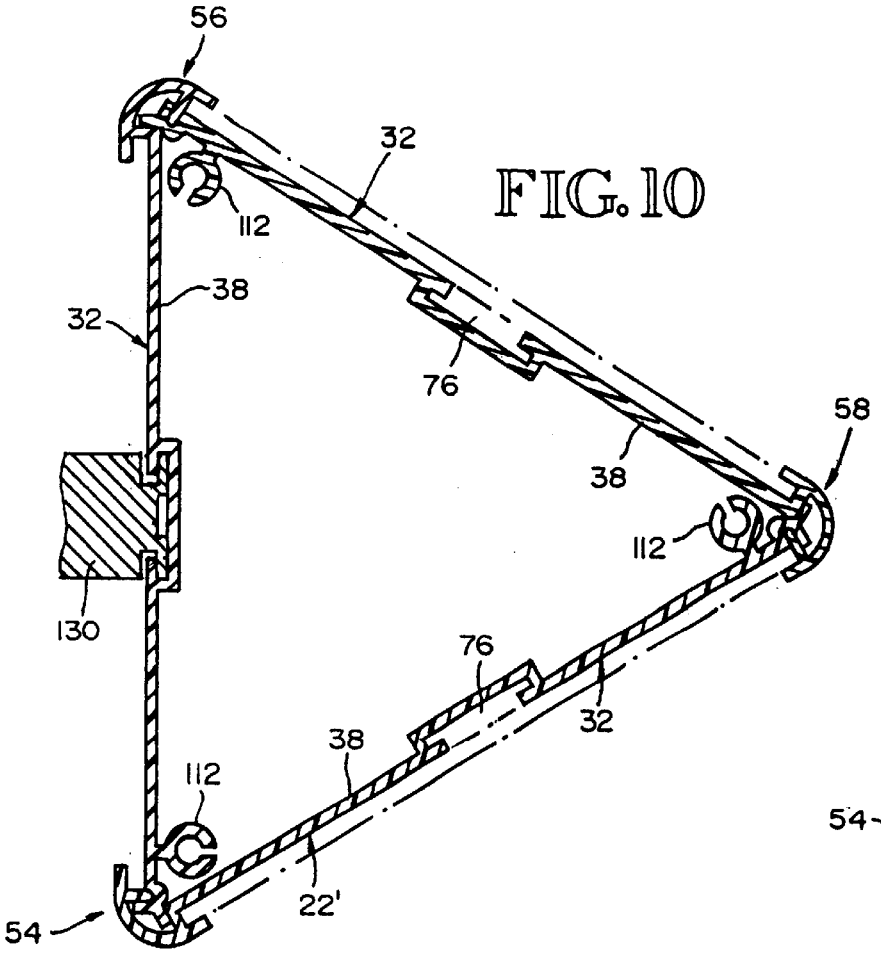
FIG. 10 is a cross sectional view similar to FIG. 3, but of a display holder that is bracket mounted by use of one or more brackets that engage a longitudinal channel that is formed in a side member.

FIG. 10 shows a vertically oriented display holder 22' that is constructed like display holders 10, 22 but which uses one of the T-slots 76 for receiving a portion of a mounting bracket 130. By way of typical and, therefore, non-limitive example, the mounting bracket may be like the mounting bracket disclosed is U.S. Pat. No. 5,419,134, granted May 30, 1995, to Scott S. Gibson, or like the mounting bracket disclosed in U.S. Pat. No. 5,722,623, granted Mar. 3, 1998 to Scott S. Gibson, or like the mounting bracket that forms the subject matter of co-pending application Ser. No. 09/411,780, filed Oct. 1, 1999 and entitled Mounting Bracket For A Display Holder. The bracket 130, whatever its construction, is connected to a shelf, a post, or other object. The display holder 22' is secured against lengthwise movement relative to the bracket 130 by a thumb screw or similar structure, such a disclosed in the aforementioned patents and application. The T-bar/T-slot connection and the thumb screw, or other mechanism, provides a rigid mount for the display holder 22'. In this embodiment, the two sides of the display holder 22' that are not mounted receive the display members.

FIG. 11 shows a display holder 140, constructed in accordance with the present invention, that is vertically oriented and is mounted by a pole or standard 142 on a base 144. Display holder 140 may be fixed in position relative to the base 144 or may be mounted for rotation relative to the base 144. The tubular body of display holder 140 may include internal structure with center openings through which the standard 142 projects. Suitable bearings may be provided at these openings, for mounting the display holder 140 on the standard for rotation about a vertical axis. FIG. 11 shows full width, full length display members 146. A similar display member may be used on a third side of the display holder 140. Or, divider strips may be placed in the T-slot 76 and used for dividing each display area into two parts on each side of the display holder 140.

Figure 15:
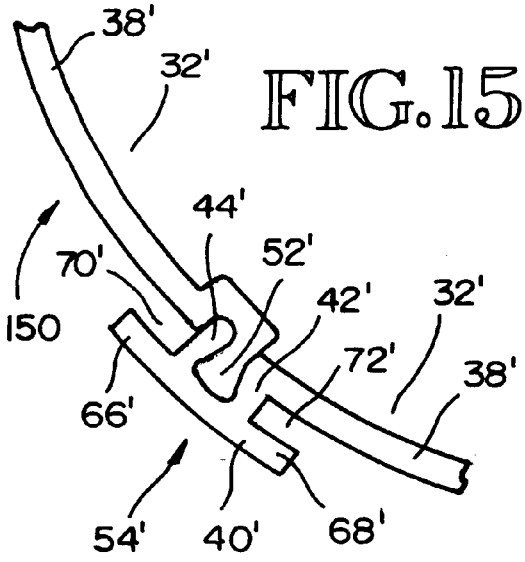
FIG. 15 is a fragmentary view of a connection formed where the tenon of one wall section is received with a mortise of a second wall section and the panel portions of the wall sections are laterally curved rather than laterally straight.

FIG. 15 is an end view of a tubular body that is formed of wall members 32' that are laterally curved. In FIG. 15, the curvature is a circular curvature. As a result, the complete body structure has a substantially cylindrical shape. The joint structure 54', 56' (not shown), 58' (not shown) is essentially like the joint structure 54, 56, 58 that is discussed above. There is an outer wall 40' that includes flanges 66', 68' that help form slots 70', 72'. A mortise is formed by and between mortise sidewalls 42', 44'. A tenon 52' is received within the mortise. The sidewalls may also be provided with screw fastener receiving members (not shown) like members 112 in FIGS. 3 and 4, for example. The substantially circular display holder 150 may also be mounted for rotation about either a horizontal or a vertical axis, such as by use of structure of the type shown in FIGS. 1 and 2, for example. Also, the display holder 150 may be formed from more than three side members. Also, each side member may be provided with T-slots (not shown) like T-slots 76 that are illustrated and are previously described. Also, a display holder may be provided that includes laterally curved walls that do not possess circular curvature. For example, a three sided display holder can be produced having sides that are laterally curved, either concave or convex, but to a small enough extent that the display holder still possess a substantially triangular cross sectional shape.

The display members may take many different forms. They may be full width, full length members, as described above in connection with FIG. 11. Or, they can be half width members, as described above in connection with FIG. 7, for example. Or they can even be smaller, such as described above in connection with FIG. 14. Also, the display members need not be full length members. A plurality of short display members may be held by an adjacent pair of confronting slots. For example, small panels which display samples of different colored paints or different types of clear varnish may be displayed. FIG. 2, for example shows a legend strip inserted between one corner slot and a center slot. It includes the names of several types of wood. Adjacent to the legend strip, stained wood samples are displayed in the display member region defined by the opposite side slot on the center divider and the confronting corner slot.

Figure 16:
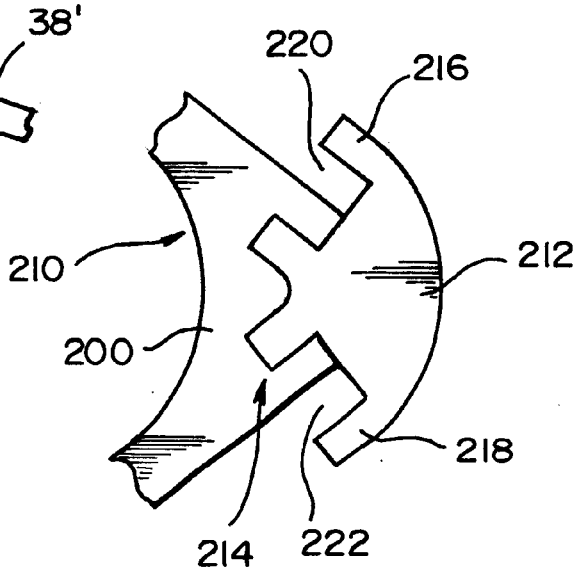
FIG. 16 is a fragmentary end view of a modified construction of the display holder, such view showing an end portion of an extruded triangular body member, an elongated corner member and a mortise and tenon joint for connecting the corner member to the body member.

FIG. 16 shows a corner region 200 of an extruded, triangular body 210. The body 210 may be a one piece extrusion having three corner portions like corner portion 200. The interior of the body 210 may be open. Or, three webs may extend inwardly, either from mid portions of the sidewalls between the corner portions 200 or inwardly from the corner portions 200. The webs meet and are connected together at the center of the body member 210. Thus, an extrusion of this type would have three longitudinal tunnel openings in it. The center region where the webs meet may include trunnions or trunnion openings at the end of the body 210, for mounting the body 210, such as in the manner shown by FIGS. 1 and 2.

FIG. 16 shows a corner strip 212 that is connected to the corner portion 200 by a mortise and tenon joint 214. Corner member 212 is also an extrusion. The cross sectional shape shown extends through the full length of the corner member 212. Corner member 212 includes flanges 216, 218 that are much like the flanges shown in and described in connection with FIG. 4, for example. The flanges 216, 218 form with the extruded body 210 a pair of display member receiving slots 220, 222. A display holder built in the manner described with respect to FIG. 16 can have the same exterior appearance as the display holders 10, 22.

Figure 17:
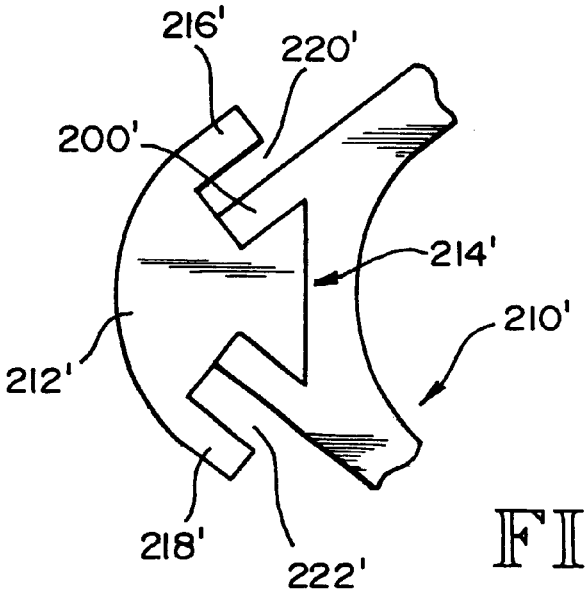
FIG. 17 is a view like FIG. 16, showing a modified construction of the mortise and tenon joint between the corner member and the body member.

FIG. 17 shows in substance the same display holder construction as FIG. 6 with the exception of the cross sectional configuration of the mortise and tenon joint 214'. The extruded body 210' has three sides and three corners and may have an open center or reinforcement webs that extend either from the sidewalls of the corners into a common meeting point in the center. Corner strips 212' include flanges 216', 218' that help define slots 220', 222' for receiving edge portions of display members.

In the embodiments of FIGS. 16 and 17, the sidewalls may be formed to include outwardly opening T-slots, such as T-slots 76 described above.

According to an aspect of the invention, one or more or all of the members or sections that form the display holders can be made from a translucent plastic material and a light can be placed inside of the display holder, so as to provide a lighted display. For example, the rear wall of the display holder shown by FIG. 10 may be made of an opaque material and the other two walls may be made of a translucent material.

A plurality of vertically oriented display holders may be mounted on a single base. The display holders may be individually rotatable on the base. The base itself may be rotatable.

The T-slots may be used to mount shelves that project horizontally outwardly from a vertically oriented display holder. By way of example, the shelves may be arranged in a spiral pattern. That is, a first lower shelf may project outwardly from a first side of the display. Then, on the next side of the display, in a clockwise direction, a second higher shelf may project outwardly from the display holder. Then, on the third side of the display holder, a still higher third shelf may be supported to extend outwardly from its side of the display holder. This arrangement of shelves can be repeated upwardly along the length of the display holder, until the top of the display holder is reached. A lighted, translucent display holder could be used with shelves arranged in a spiral pattern.

Also, in place of shelves, wire hooks may extend outwardly from the T-slots. Each T-slot may include a vertical tier of wire hooks. Also, the display holder may be provided with an spiral pattern of wire hooks.

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. A display holder, comprising:

three side members;

each side member having a first margin portion, a second margin portion and an intermediate panel portion;

each first margin portion including an outside corner wall and first and second mortise side walls extending inwardly from the corner wall, said corner and mortise side walls together forming a longitudinal mortise having a narrow entrance slot;

each second margin portion including a narrow stem and a tenon outwardly of the stem that is wider than the stem;

each said tenon being sized to be received within a said longitudinal mortise;

each said narrow stem being sized to be received within an entrance slot when its tenon is within its mortise;

wherein the tenon of each said side member is received within a longitudinal mortise of an adjacent side member, and its narrow stem is received within the entrance slot for its mortise; and wherein such engagement of the tenons and longitudinal mortise connect the side members together to form and elongated, three sided hollow body having three corners.

2. The display holder of claim 1, wherein at each corner first mortise sidewall is connected to and extends perpendicularly outwardly from the panel portion of a first side member at the corner, to a connection with the corner wall, wherein the corner wall is laterally curved, wherein the second mortise sidewall extends substantially radially inwardly from the corner wall and includes a free edge that is spaced from where the first mortise sidewall is connected to the panel portion of the first side member, and wherein the mortise at such corner is formed by and between said free edge and a corner formed where said first mortise sidewall is connected to the panel portion of the first side member.

3. The display holder of claim 2, where at each corner the tenon has side surfaces that are contiguous inside side surfaces of the mortise, wherein the second mortise sidewall is positioned between the tenon and an edge of the panel portion of a second side member at the corner, and wherein the stem extends from a connection with the panel portion of the second side member, to and through the narrow entrance slot to the tenon.

4. The display holder of claim 3, wherein the first side member further includes a display member receiving slot formed by the first mortise sidewall, by an adjacent portion of the panel portion of the first sidewall, and by a flange that is a portion of said corner wall that extends from the corner, generally perpendicular to the first mortise sidewall and generally parallel to the panel portion of the side member.

5. The display holder of claim 4, wherein a display member receiving slot is formed at said corner by an outside corner of the panel portion of the second side member, by a surface of the second mortise sidewall, and by a second flange that is a portion of the corner wall that extends from the corner, generally perpendicular to the second mortise sidewall and generally parallel to the border of the panel portion of the second side member.

6. The display holder of claim 3, wherein a display member receiving slot is formed at said corner by an outside corner of the panel portion of the second side member, by a surface of the second mortise sidewall, and by a flange that is a portion of the corner wall that extends from the corner, generally perpendicular to the second mortise sidewall and generally parallel to the border of the panel portion of the second side member.

7. The display holder of claim 1, further comprising a pair of end members, one at each end of the hollow body, said end members being connected to the hollow body.

8. The display holder of claim 7, wherein the hollow body extends horizontally, and mounting brackets are connected to the end members.

9. The display holder of claim 8, comprising pivotal connections between the mounting brackets and the end members of the display holder, for mounting the display holder for rotation about a horizontal axis.

10. The display holder of claim 7, wherein the hollow body is elongated in the vertical direction, and mounting brackets are connected to the end members, for mounting the display holder.

11. The display holder of claim 10, wherein the mounting brackets include pivot connections mounting the display holder for rotation about a substantially vertical axis.

12. The display holder of claim 7, wherein the three side members each includes a screw receiving portion on its inside, adjacent a corner, and screw fasteners extending through the end members and connecting them to screw fastener receiving portions of the side members.

13. The display holder of claim 12, wherein the screw fastener receiving portion extends longitudinally of each side member, closely adjacent the margin portion of the side member that includes the narrow stem and the tenon.

14. The display holder according to claim 1, further comprising a base and a post extending upwardly from the base to which the hollow body of the display holder is connected.

15. The display holder of claim 1, further comprising a pair of slots at each corner, each said corner including a slot confronting a slot at each other corner.

16. The display holder of claim 15, wherein the intermediate panel portion of each side member includes at least one outwardly directed T-slot.

17. The display holder of claim 16, further comprising an insert for the T-slot including a T-bar in the T-slot, a perpendicular wall extending outwardly from the T-bar, and at least one flange on the perpendicular wall that extends parallel to the intermediate panel portion of the side member, said flange and perpendicular wall forming a display member receiving slot that confronts a said corner slot, whereby a display member can be mounted on the hollow body with margin portions of the display member within a corner slot and a confronting slot.

18. The display holder of claim 1, wherein each side member is laterally curved.

19. The display holder of claim 18, wherein the curvature of each side member is a circular curvature.

20. A display holder, comprising:

a first side member;

a second side member;

a third side member;

each side member having a first margin portion that includes a mortise extending longitudinally of the side members;

and a second margin portion that includes a tenon that extends longitudinally of the side member;

wherein the tenon of the first side member is received within the mortise of the second side member, and the tenon of the second side member is received within the mortise of the third side member, and the tenon of the third side member is received within the mortise of the first side member;

wherein such engagement of the mortise and tenons connects the side members together to form an elongated, three sided hollow body having three corners;

wherein the corner formed where the first and second side members are connected together includes a pair of display member receiving slots, one directed towards the corner where the first and third side members are connected together and the other directed towards the corner where the second and third members are connected together, wherein the corner formed where the first and second side members are connected together includes a display member receiving slot that is directed towards the corner formed where the first and second side members are connected together, and the corner where the second and third side members are connected together includes a display member receiving slot that is directed towards the corner formed where the first and second side members are connected together; and wherein at least one of the first and second sidewalls includes an outwardly directed longitudinal T-slot in it at a location between the two margin of said side member, said display holder further including a T-bar positioned within the T-slot, a perpendicular wall extending outwardly from the T-bar, and at least one flange on the perpendicular wall together with the perpendicular wall and the side member forms a display member receiving slot that confronts a said corner slot.

21. A display holder, comprising:

a first side member;

a second side member;

a third side member;

each side member having a first margin portion that includes a mortise extending longitudinally of the side members;

and a second margin portion that includes a tenon that extends longitudinally of the side member;

wherein the tenon of the first side member is received within the mortise of the second side member, and the tenon of the second side member is received within the mortise of the third side member, and the tenon of the third side member is received within the mortise of the first side member;

wherein such engagement of the mortise and tenons connects the side members together to form an elongated, three sided hollow body having three corners; and wherein the third side member includes a T-slot, and the display holder further includes a T-bar in the T-slot, and a mounting member that is connected to the T-bar.

22. A display holder, comprising:

a plurality of side members, each said side member having a first margin portion that includes a mortise extending longitudinally of the side member and a second margin portion that includes a tenon that extends longitudinally of the side member;

wherein the tenon of each side member is received within a mortise of an adjacent side member, and the engagement of the mortise and tenons connects the side members together to form an elongated hollow body;

wherein at each mortise and tenon connection there is a pair of oppositely directed slots, each sized to receive an edge portion of a display member; and wherein at least one side member includes an outwardly opening, longitudinal T-slot, and a divider strip is positioned within the T-slot, and said divider strip includes at least one slot sized to receive an edge portion of a display member.

23. The display holder of claim 22, wherein the side members have intermediate panel portions between the margin portions that are substantial flat.

24. The display holder of claim 22, wherein the side members are laterally curved.

25. The display holder of claim 24, where the curvature of the side members is substantially a circular curvature.

26. A display holder, comprising:

an elongated body having three sides, three corners and a substantially triangular cross sectional configuration;

a pair of flanges at each corner, each said flange being in coplanar parallelism with a related flange at a different corner;

wherein said flanges are spaced outwardly from side portions of the body and form longitudinal slots for receiving edge portions of display members; and three corner members and mortise and tenon joints connecting the corner members to the body, said corner members including the flanges.

27. The display holder of claim 26, wherein said body includes three sidewalls, at least one of which includes an outwardly opening, longitudinal T-slot.

28. The display holder of claim 27, including a divider strip positioned within the T-slot, said divider strip including at least one slot that confronts a corner slot and is sized to receive an edge portion of a display member.

* * * * *